US010214983B2

(12) United States Patent
Wood

(10) Patent No.: US 10,214,983 B2
(45) Date of Patent: Feb. 26, 2019

(54) MECHANICAL HAMMERING TOOL FOR USE IN OIL WELLS

(71) Applicant: Loxley Holding AS, Rennesøy (NO)

(72) Inventor: John Robert Loxley Wood, Rennesøy (NO)

(73) Assignee: Loxley Holding AS, Rennesøy (NO)

( * ) Notice: Subject to any disclaimer, the term of this patent is extended or adjusted under 35 U.S.C. 154(b) by 149 days.

(21) Appl. No.: 15/128,329

(22) PCT Filed: Apr. 10, 2015

(86) PCT No.: PCT/NO2015/050066
§ 371 (c)(1),
(2) Date: Sep. 22, 2016

(87) PCT Pub. No.: WO2015/156682
PCT Pub. Date: Oct. 15, 2015

(65) Prior Publication Data

US 2017/0191330 A1 Jul. 6, 2017

(30) Foreign Application Priority Data

Apr. 11, 2014 (NO) ..... 20140479

(51) Int. Cl.
*E21B 31/107* (2006.01)
*E21B 23/00* (2006.01)
(Continued)

(52) U.S. Cl.
CPC ..... *E21B 31/107* (2013.01); *E21B 23/00* (2013.01); *E21B 23/006* (2013.01); *E21B 23/10* (2013.01); *E21B 31/00* (2013.01)

(58) Field of Classification Search
CPC ..... E21B 31/107
See application file for complete search history.

(56) References Cited

U.S. PATENT DOCUMENTS 2,008,765 A * 7/1935 McCullough ..... E21B 31/107 175/303
2,122,751 A * 7/1938 Phipps ..... E21B 31/107 175/299

(Continued)

FOREIGN PATENT DOCUMENTS

GB 2194573 A 3/1988
GB 2350134 A 11/2000

(Continued)

OTHER PUBLICATIONS

Wikheim, Martin N., "International Search Report," prepared for PCT/NO2015/050066, dated Jul. 2, 2015, three pages.

*Primary Examiner* — Kipp C Wallace
(74) *Attorney, Agent, or Firm* — Winstead PC

(57) ABSTRACT

The invention relates to a cable-operated hammering tool (20) for downhole operations, comprising an extended cylinder (3) with an axially through-going internal opening in the cylinder (3), a hammering part (10) is arranged in a lower section of the cylinder (3) and is fitted with a detachable coupling for the connection with downhole equipment, a release strut (1) is arranged in the upper section of the cylinder (3) that is connected to a cable which is connected to a surface installation, the hammering part is detachably fastened to the cylinder (3) with the help of, at least, one locking body (4). The release strut (1) is functionally connected to a force spring (2) for prestressing of this by moving in a first direction, and also functionally coupled to the, at least, one locking body (4) to be released from this by moving in an opposite direction.

13 Claims, 9 Drawing Sheets

(51) Int. Cl.
*E21B 23/10* (2006.01)
*E21B 31/00* (2006.01)

(56) References Cited

U.S. PATENT DOCUMENTS

| | | | | |
|---|---|---|---|---|
| 2,126,241 | A * | 8/1938 | Black | E21B 31/107 175/299 |
| 4,142,597 | A | 3/1979 | Johnston | |
| 4,333,542 | A * | 6/1982 | Taylor | E21B 31/107 175/299 |
| 4,919,219 | A | 4/1990 | Taylor | |
| 2001/0018974 | A1* | 9/2001 | Mouton | E21B 31/113 166/301 |
| 2002/0112866 | A1 | 8/2002 | Buyers et al. | |
| 2005/0150693 | A1 | 7/2005 | Madden | |

FOREIGN PATENT DOCUMENTS

| | | | |
|---|---|---|---|
| WO | 20120728 | A | 12/2013 |
| WO | WO-2013191564 | A1 | 12/2013 |

* cited by examiner

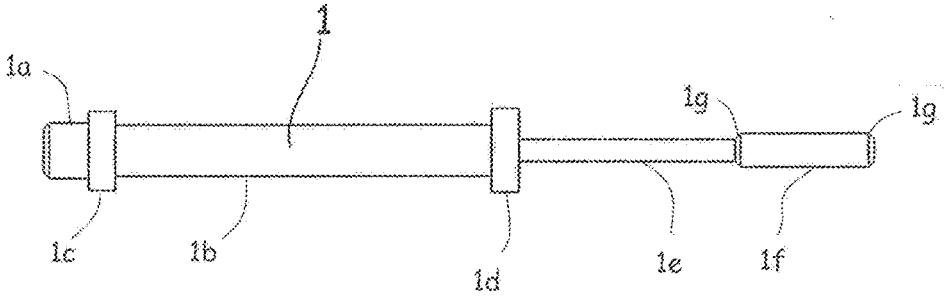
Fig 3.1
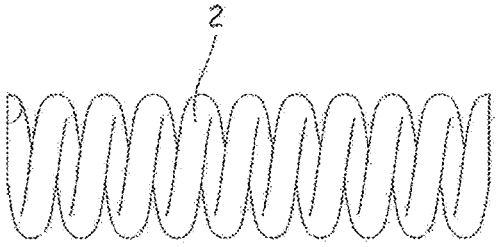
Fig 3.2
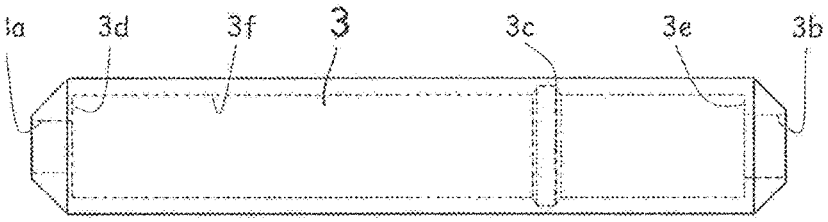
Fig 3.3
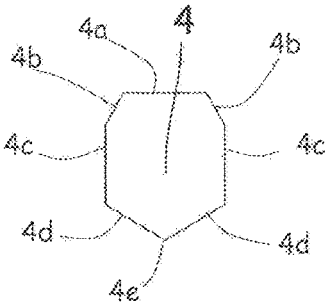
Fig 3.4
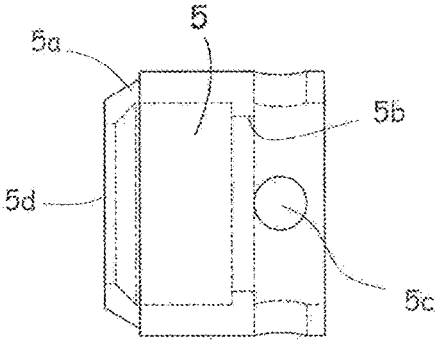
Fig 3.5

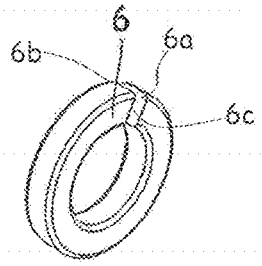
Fig 3.6
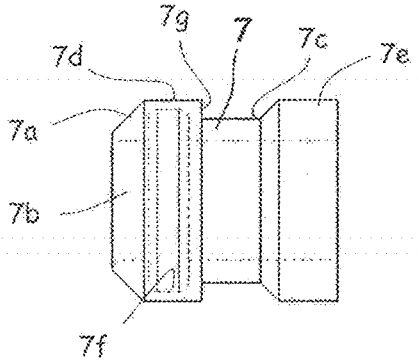
Fig 3.7
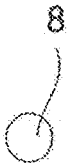
Fig 3.8
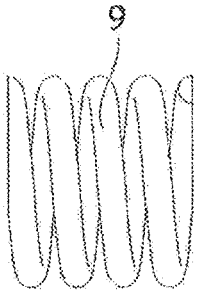
Fig 3.9
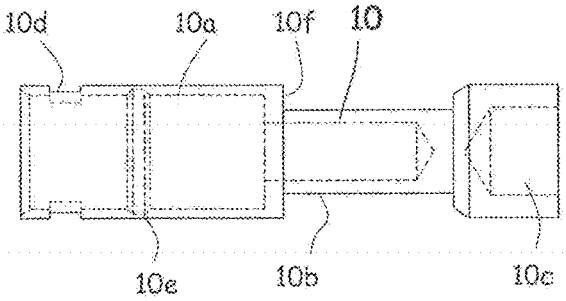
Fig 3.10

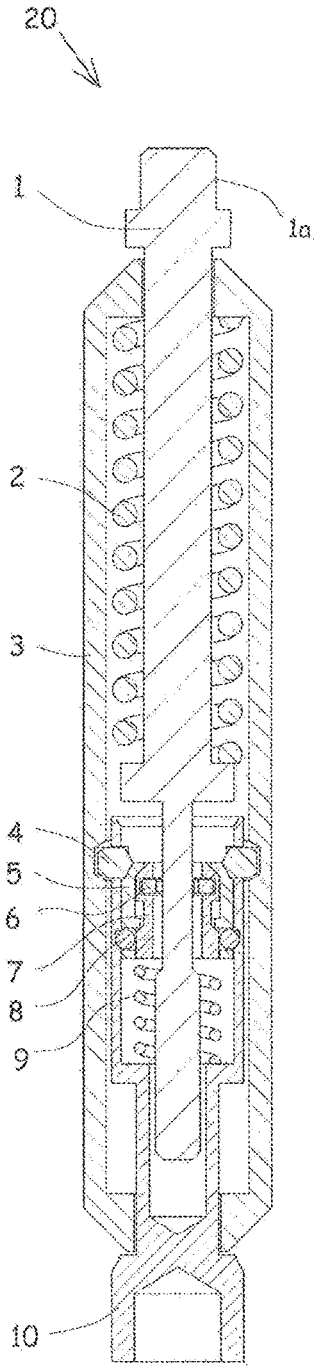
Fig 4.1
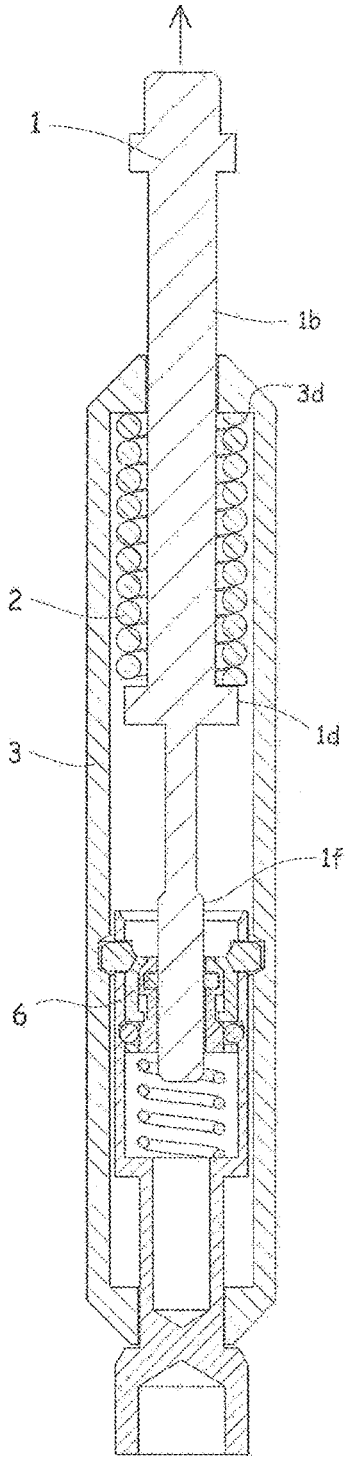
Fig 4.2
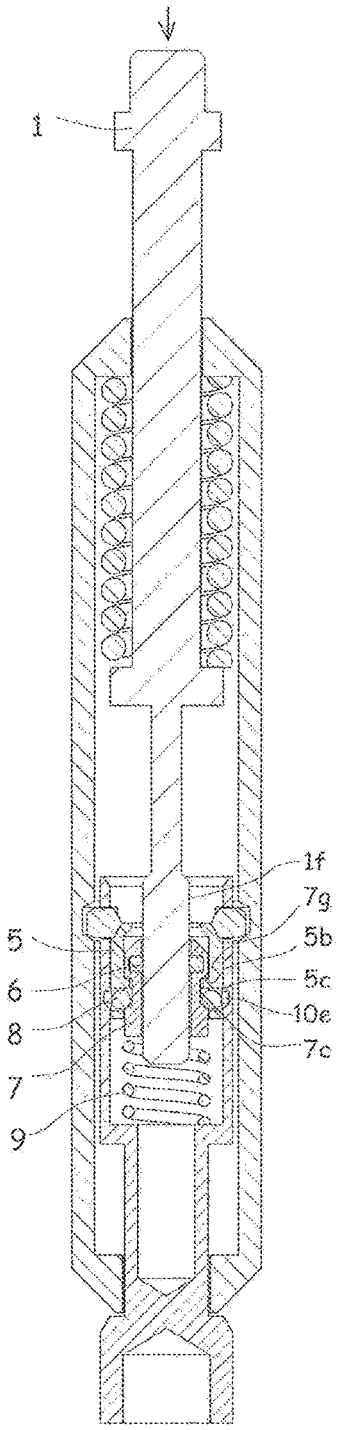
Fig 4.3

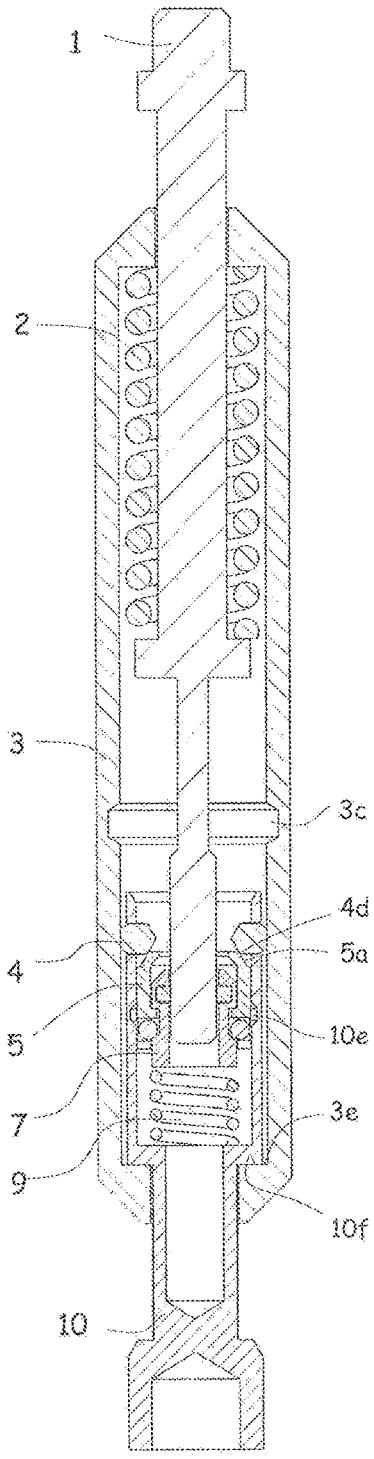
Fig 4.4
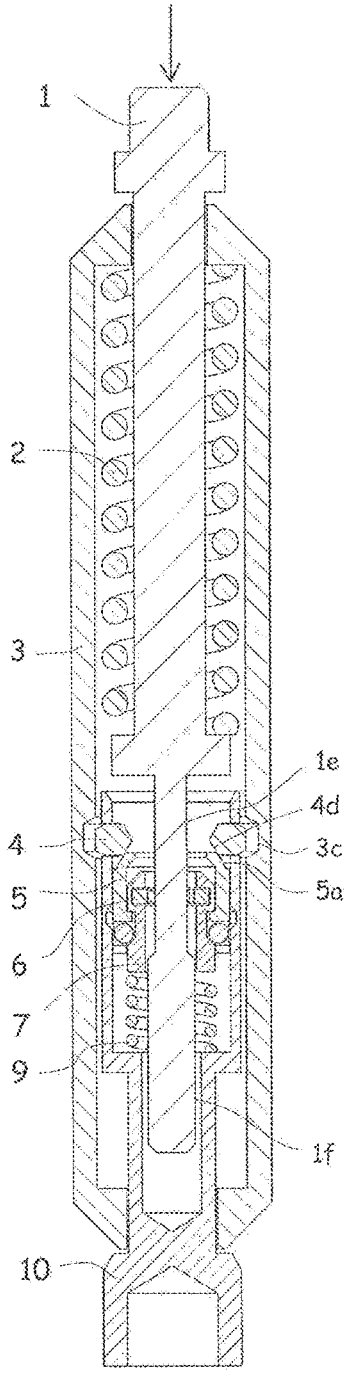
Fig 4.5
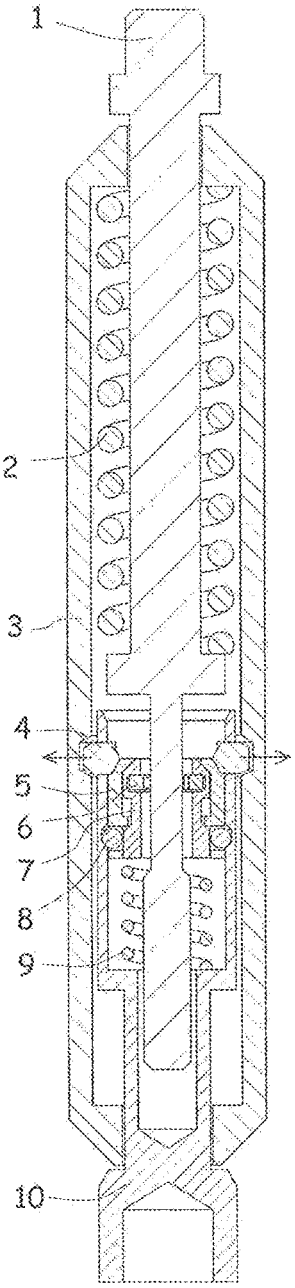
Fig 4.6

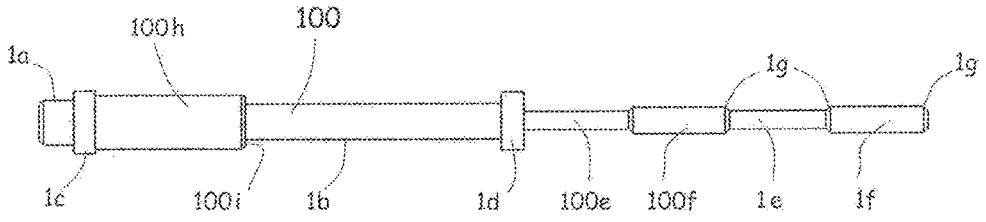
Fig 7.1
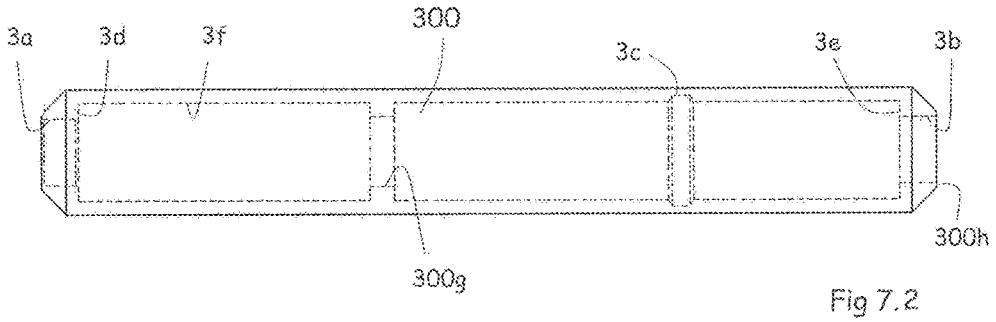
Fig 7.2
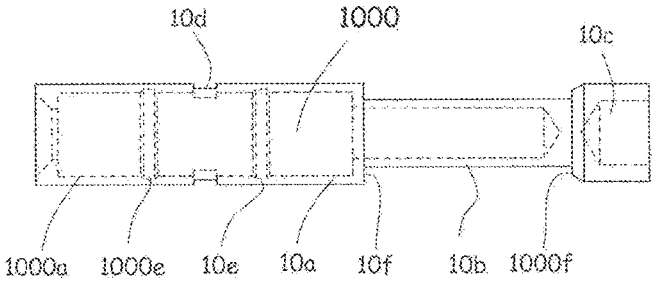
Fig 7.3

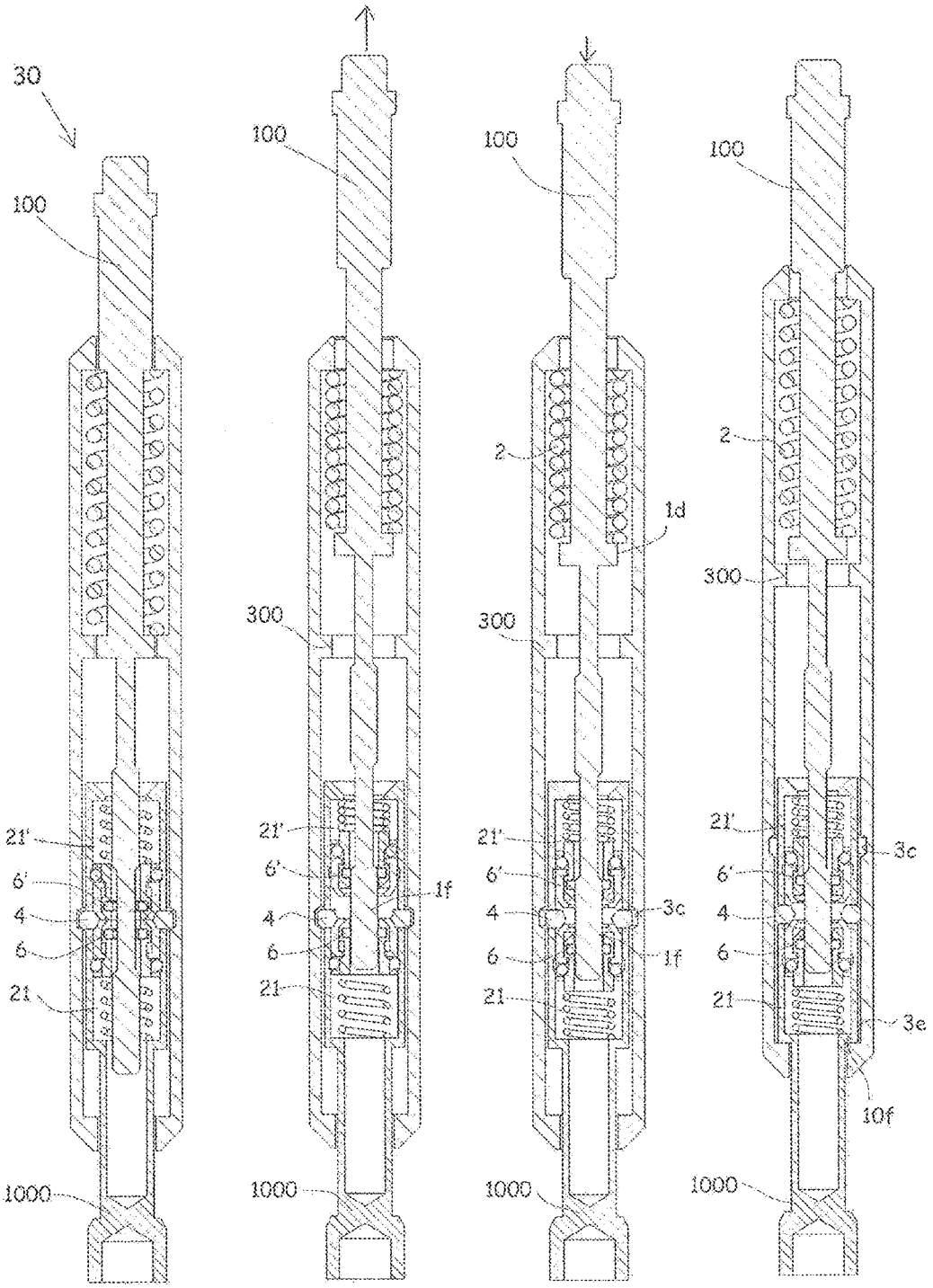
Fig 8.1 Fig 8.2 Fig 8.3 Fig 8.4

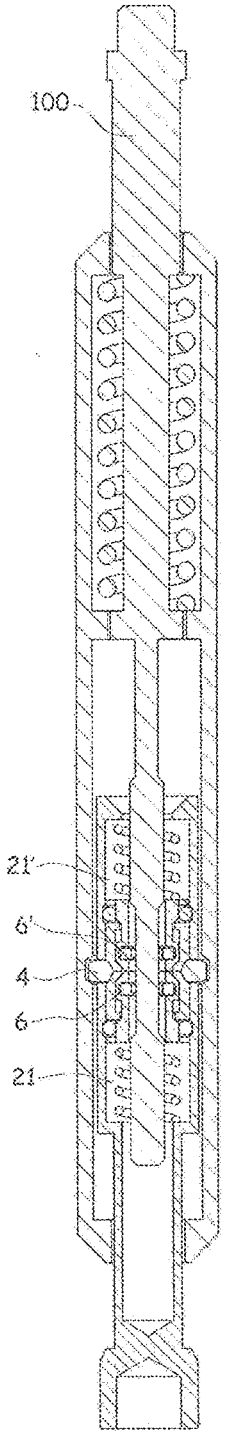
Fig 8.5
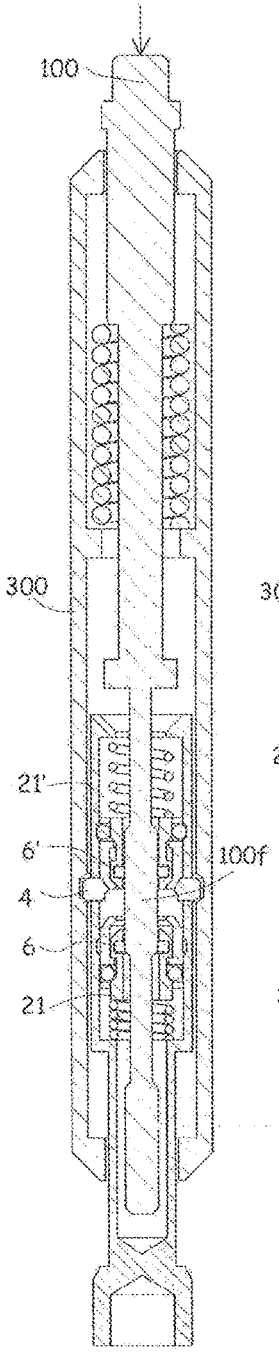
Fig 8.6
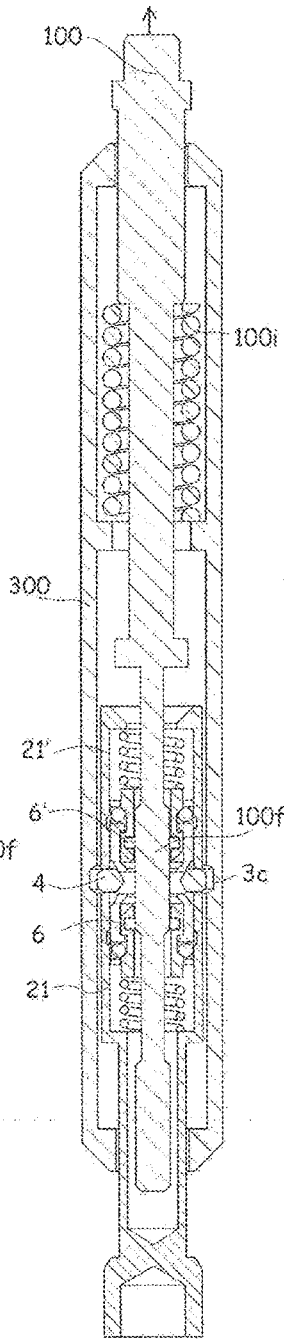
Fig 8.7
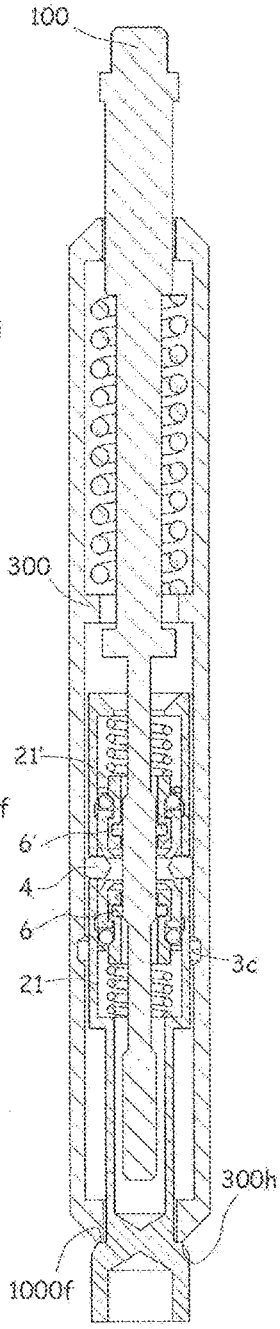
Fig 8.8

MECHANICAL HAMMERING TOOL FOR USE IN OIL WELLS

FIELD OF THE INVENTION

The present invention relates to a hammering tool for use in oil wells, in particular a mechanical hammering tool (jar) to be used to perform various operations where there is a need for a powerful and varied hammering force. The invention also relates to a method for the use of the tool.

BACKGROUND TO THE INVENTION

As long as oil drilling has existed, different well service tools have been used with the objective of delivering a powerful blow for carrying out a certain operation, for example, in the collecting of various equipments in the well, breaking of glass plugs in the well, in the opening or closing of a production valve in the well or similar operations.

Initially, the so called Spang jars or tubular jars were used, which originally are composed of a steel body that is accelerated a certain distance before it abruptly stops mechanically and thereby delivers a hammering energy. These are commonly used where there is a need for one blow only of relatively little force as the acceleration is normally manual in that a person pulls on a taut wire.

More refined versions have gradually been introduced where one has either a typical mechanical jar or hydraulic jar where a much higher kinetic energy can be pre-stressed in the wire before the release. These often use a so-called accelerator fitted over itself as a spring packet that stores/accumulates the kinetic tension force energy relatively near the jar as opposed to only using the kinetic tension energy in a taut wire. The taut wire will be much slower to accelerate the jar as the wire can be many thousand meters long.

Today, primarily two kinds of jars, also called hammering tools, are used in the industry, namely mechanical and hydraulic jars. Both have advantages and disadvantages in use.

With the mechanical jars, a certain release force is pre-set, which leads to the tool delivering a certain hammering energy when it comes up to the tension force that has been pre-set. This will then deliver a blow immediately the tension force has been reached. Mechanical jars have no seals where one can close off the well pressure, but they have a simple design.

The disadvantages are that the hammering force is limited to the pre-set value before the tool went into the well and the tension release force must be set/verified with a suitable tool before use.

Hydraulic jars have the advantage in that they give an optional hammering power dependent on the pre-stressing force and that no preparations with the pre-stressing of the release force are necessary before use.

The disadvantages with the use of hydraulic jars are that these have a more complex construction; they are more expensive, require more maintenance and must be overhauled more often. In addition, there is a risk of locking the well pressure inside the tool if leakages occur. A given holding time is also required for each hammering (typically 0.5-2 min) that can result in the job taking an unnecessary long time if many blows are required to carry out the operation.

The wells that are drilled today are both longer and deeper than before. This leads to both the pressure and temperature increasing in these wells. With operations furthest down in these wells, mechanical jars will be preferred for safety reasons, although it will undoubtedly be most operationally appropriate to use hydraulic jars with the functional advantages they have.

NO20120728 shows a re-setting arrangement for cable operated hammering pipes. A mechanical hammering tool is shown where a given, but adjustable, release force, can be changed in that the sending of the tool down will rotate a circular J-slot casing/setting mechanism to the next step and thereby change the compression distance on a release spring and change the release force. The adjustment operation of the next step must be carried out manually. The J-slot casing/setting mechanism has a changing axial length position dependent on the twisting orientation. This makes it difficult to make major changes to the release force as this must go through several steps to come to the required release force. With the release, the lower trunk section will be led upwards and the trunk lock will engage with a groove in the housing, the upper trunk section comes lose from the lower trunk section and is led further up until it meets the upper edge of the housing.

U.S. Pat. No. 4,919,219 describes a mechanical hammering tool where a given, but adjustable, release force can be altered if necessary in that a downwards pushing with a given force will rotate a circular J-slot to the next step and thereby change the compression distance on a release spring and thereby also alter the release force. As with NO20120728, one must, in this publication, consciously carry out an adjustment operation to the next release step according to need. The J-slot casing/setting mechanism is rotary and has a changing axial length position dependent on the orientation of the twisting.

The present invention distinguishes itself from the prior art publications in that they have fixed release steps within a certain interval where the adjustment to the next step must be carried out physically and deliberately by the operator as opposed to the present invention where the adjustment of the release force is an integrated part of normal jar operation.

The present application is derived and developed to overcome the weaknesses of the known method and to achieve further advantages.

SUMMARY OF THE INVENTION

The invention provides a cable-operated hammering tool for downhole operations, comprising

- an extended cylinder with an axially through-going internal opening in the cylinder,
- a hammering part arranged in a first section of the cylinder, said hammering part is fitted with a detachable coupling for connection with downhole equipment
- a release strut arranged in a second section of the cylinder, said release strut is connected to a surface installation via a cable,
- said hammering part is detachably coupled to the cylinder by at least, one locking unit in a locked position of said locking unit. The invention is distinctive in that the cable operated hammering tool further comprises a force spring that is in contact with the release strut for the pre-biasing of said release strut by movement of said release strut in a first direction, that said release strut is displaceable in a second opposite direction, said release strut being coupled to said locking unit, so that when said release strut is moving in said second direction it is displacing said locking unit from said locked position and thereby releasing the hammering part from the cylinder. This provides a hammering tool where the release force is easy to pre set by the force spring to any desired compression distance in the hammering tool. The compression distance is not limited by a number of fixed positions as j-slot. The pre set force determine the force of the stroke in the hammering tool.

The invention relates to a cable operated hammering tool for downhole operations, comprising an extended cylinder with an axially, through-running opening internally in the cylinder, a hammering part is arranged in the lower section of the cylinder and is fitted with a detachable coupling for the connection with downhole equipment, a release strut is arranged in an upper section of the cylinder that is connected to a cable which is coupled to a surface installation, the hammering part is detachably fastened to the cylinder with the help of, at least, one locking body. The invention is special in that the release strut is functionally coupled to a force spring for the pre-stressing of this by movement in a first direction, and also functionally coupled to the, at least, one locking body for the release of this by movement in the opposite, second direction.

Advantageous embodiments of the invention are given in the dependent claims 1-10.

A method for the operation of a hammering tool for downhole operations, said hammering tool comprising a cylinder with an axially through-going internal opening in the cylinder, where said cylinder is fitted with an internal cylinder edge, a hammering part arranged in a first section of the cylinder and fitted with a detachable coupling for the connection with downhole equipment, said hammering part is fitted with a hammering edge, a release strut arranged in a second section of the cylinder is adapted to be connected to a surface installation via a cable said hammering part is detachable coupled to the cylinder by at least one locking unit in a locked position of said locking unit at least one locking body is arranged between the cylinder and the hammering part, adapted to couple said cylinder and hammering part together The method is distinctive in that the method comprising the following steps:

a) the release strut is moved a distance in a first axial direction to compress a force spring to a pre stressing force, said force spring is arranged between the cylinder and the release strut, b) the release strut is moved a distance in the axially opposite direction and the at least one locking unit is moved a distance from the at least one locking body so that the pre-stressing diminishes c) the at least one locking body is released from the cylinder housing d) the pre-stressing force in the force spring causing said cylinder to move a distance in the first axial direction The invention also relates to a method for use of a hammering tool in downhole operations, comprising an extended cylinder with an axially, through-going opening internally in the cylinder, said cylinder is fitted with an internal cylinder edge, a hammering part arranged in the lower section of the cylinder and fitted with a detachable coupling for the connection to downhole equipment, said hammering part is fitted with a hammering edge.

a release strut is arranged in the upper section of the cylinder and is connected to a cable that is connected to a surface installation.

cylinder and hammering part are initially coupled together by the locking body that is pre-tensed with the help of a release mechanism or a locking unit:

The method is special in that it comprises the following steps:

a) the release strut is pushed a distance in a first axial direction to a force spring arranged between the cylinder, and the release strut is compressed to the desired pre-stressing force, b) the release strut is pushed a smaller distance in the axially opposite direction and the release mechanism is led a distance from the locking bodies so that the pre-stressing diminishes, c) the locking bodies are released from the cylinder housing, d) the pre-stressing force in the force spring leads the cylinder a distance in the first axial direction, e) the lower edge in the cylinder hits the hammering edge in the hammering part so that a blow is generated in the tool, f) the release strut is pulled back by the force spring and the, at least, one release mechanism is pulled towards the locking bodies, the locking bodies are brought back in the engagement with the cylinder in its initial position.

Advantageous methods of the invention are given in the dependent claims 12-13.

The advantages with the invention in relation to existing solutions are, among other things, that:

The hammering tool has a simpler design than traditional hammering tools.

It immediately provides a blow when the wanted tension force has been reached.

There are no seals where the well pressure can be closed in.

The hammering tool of the invention provides optional hammering power dependent on the pre-stressing force in that the blow happens immediately when the tension force diminishes by about 5%.

The hammering tool according to the invention has more freedom in choice of hammering power. There are no fixed positions which the hammering tool must choose for each blow.

The tool can be used without an accelerator as this function is integrated in the tool. This means that the tool is more compact and builds less than traditional hammering tools.

The hammering tool can also be used in both shallow waters and deep waters.

The hammering tool can be both single-acting and double-acting.

SHORT DESCRIPTION OF THE FIGURES

These and other characteristics will be clear from the following description of a preferred embodiment, given as a non-limiting example, with reference to the associated figures, where:

FIGS. 3.1-3.10 are schematic presentations of individual components of the hammering tool.

FIG. 4.1-FIG. 4.6 are schematic presentations of the individual sequences which the single-acting tool goes through from its starting position to the hammering position and back to the initial position.

Figure 5:
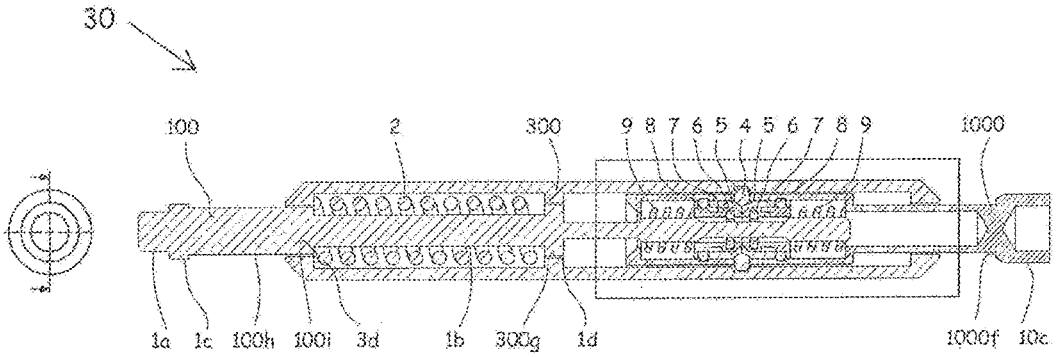

FIG. 5 shows a schematic presentation of an embodiment of the mechanical hammering tool according to the invention where the hammering tool is double-acting.

Figure 6:
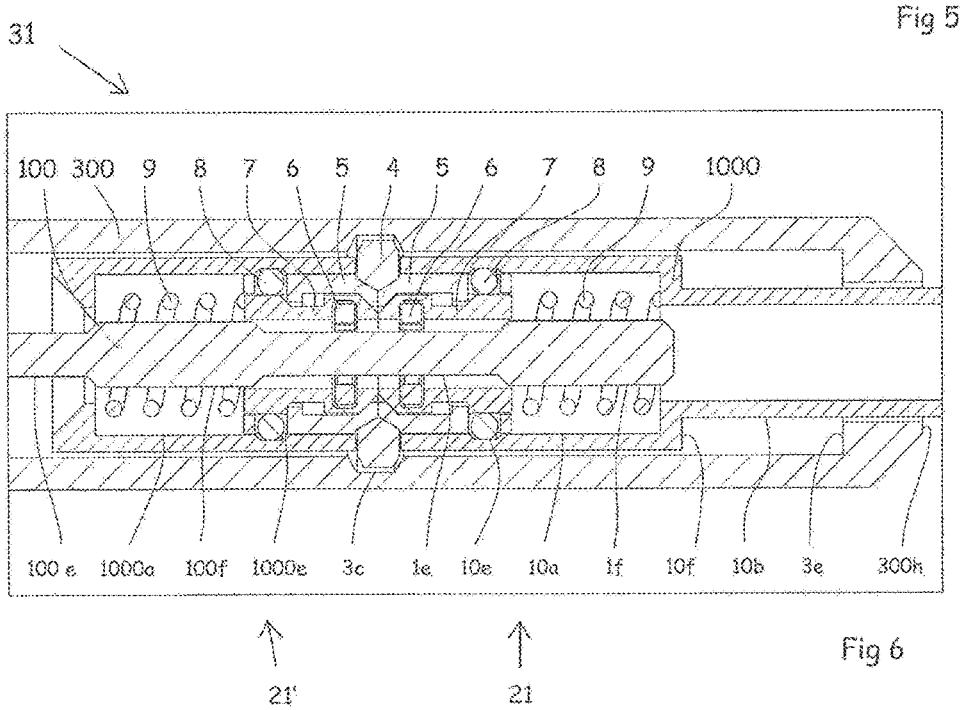

FIG. 6 shows a detailed section of the release mechanism in the double-acting hammering tool shown in FIG. 5.

FIG. 7.1 shows a schematic presentation of the release strut of the double-acting hammering tool shown in FIG. 5.

FIG. 7.2 shows a schematic presentation of the connection housing of the double-acting hammering tool shown in FIG. 5.

FIG. 7.3 shows a schematic presentation of the hammering part of the double acting hammering tool shown in FIG. 5.

FIGS. 8.1-8.8 show schematic presentations of the individual sequences that the double-acting hammering tool shown in FIG. 5 goes through from the initial position to hammering position and back to the initial position.

DETAILED DESCRIPTION OF AN EMBODIMENT

Figure 1:
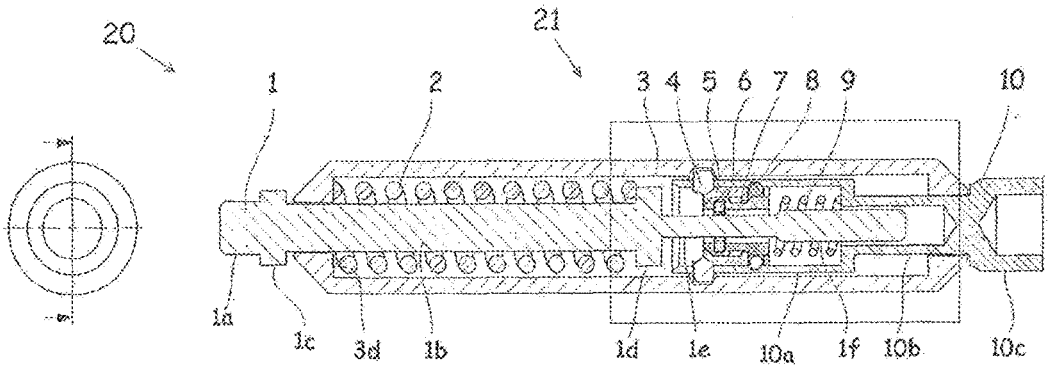
FIG. 1 is a schematic presentation of a single-acting mechanical hammering tool according to the invention.

FIG. 1 shows a an embodiment of a single-acting hammering tool 20 for use in oil wells. The hammering tool is, at a first section, connected to a cable (not shown) that runs up to a surface installation fitted with, in themselves known, means set up for driving the cable into and out of the bore hole, including positioning of connected equipment and application of a given tension in the cable.

At the other, first end the hammering tool is connected to downhole equipment (not shown). The hammering tool 20 comprises a release strut 1 and a hammering part 10 that is arranged on each side of a hollow cylinder 3 also called connecting housing. A release mechanism, hereinafter called a locking unit 21 is arranged between the release strut 1 and the hammering part 10. (This is shown in detail in FIG. 2). The locking unit is arranged in a locked position in FIG. 2 as well as FIG. 6.

The release strut 1 has the form of an extended trunk comprising a thread 1*a* arranged on the outside of the cylinder 3 and coupled to the cable (not shown) and a release end 1*f* that stretches towards the hammering part 10 inside the cylinder 3. Details of the shape of the release strut 1 are shown in FIG. 3.1. The release strut 1 is formed as a cylindrical element comprising parts of different diameters. The thread 1*a* is, as mentioned previously, arranged on the outside of the cylinder 3. A first intermediate part 1*b* is arranged inside the cylinder 3, towards the end 1*a*. A first parapet section 1*c* forms the connection between the end 1*a* and the intermediate part 1*b*. The first parapet section 1*c* has a diameter that is larger than the parts 1*a* and 1*b*, and larger than the opening 3*a* in the cylinder 3. This means that the end 1*a* cannot be led into the cylinder 3, but stops at the parapet section 1*c*. A second parapet section 1*d*, which in turn is connected to another intermediate part 1*e*, is arranged at the other end of the first intermediate part 1*b*. The second intermediate part 1*e* has a diameter which is smaller than the parts 1*a* and 1*b*. The second intermediate part 1*e* is also connected to the release end 1*f*. This release end 1*f* has a diameter which is larger than the second intermediate part 1*e* and smaller than the parts 1*a* and 1*b*. At the end towards the second intermediate part 1*e* the release end 1*f* preferably has a conical shape 1*g* that runs from the release end 1*f* diameter to the second intermediate part 1*e* diameter. It is preferred that the release end 1*f* has a corresponding conical shape 1*g*' at the end that stretches towards the hammering part 10. Other shapes suitable for carrying out the invention other than conical are possible embodiments of the invention.

Furthermore, the hammering tool 20 comprises a force spring 2 arranged around the first intermediate part 1*b* of the release strut 1. The force spring 2 is arranged between the second parapet section 1*d* on the release strut 1 and a cylinder edge 3*d* at the inside of a first section of the cylinder 3. A gap between the second parapet section 1*d* and the internal wall 3*f* of the cylinder 3 is smaller than the force spring 2 so that this is prevented from passing the parapet section 1*d* when it is compressed. This means that the parapet section 1*d* keeps the force spring in the first intermediate part 1*b* and prevents it from moving towards the second intermediate part 1*e* when the force spring is compressed.

The force spring 2 is shown separately in FIG. 3.2. Here, it is formed as a spiral spring of, for example, steel wire or similar materials, the force spring 2 can possibly also be a cup spring or other springs that are appropriate for the implementation of the invention. The force spring could also be other resilient members suitable to set a pre-biased force.

The hammering part 10 shown in FIG. 3.10 has the form of an extended cylindrical trunk and has a hammering release end 10*a* lying inside the cylinder 3 against the release strut 1. The hammering release end 10*a* has the form of a hollow cylinder and envelops the locking unit 21. At the other end towards the well, a hammering end 10*c* is arranged. The hammering end 10*c* and the hammering release end 10*a* could have the same diameter, but this is not a requirement of the invention.

A cylindrical intermediate piece 10*b* is arranged between the ends 10*a* and 10*c*. This intermediate piece 10*b* has a smaller diameter than the end pieces 10*a*, 10*c* and is adapted to correspond with the diameter of the opening 3*b* in the first section of the cylinder 3. Slits 10*d* are also arranged in the hammering release end 10*a*. These are arranged diametrically opposite each other and are adapted correspond with the shape of the locking bodies 4 that are described in more detail below.

In addition, there is a groove 10*e* is arranged on the inside of the hammering release end 10*a*. This groove 10*e* is adjusted to blocking devices 8 that are described in further detail below. The hammering release end 10*a* has a larger diameter than the intermediate piece 10*b* so that there is a hammering edge 10*f* in the transition between these.

The cylinder 3 or connecting housing is shown in detail in FIG. 3.3. It is formed as a cylindrical housing with an opening 3*a* in the second section of the cylinder towards the cable end. The opening corresponds with the diameter of the first intermediate part 1*b* of the release strut 1 so that the release strut can move in the longitudinal direction. The first section of the cylinder 3 facing an opening 3*b* towards the downhole tool is adjusted or corresponds with the diameter of the intermediate piece 10*b* of the hammering part 10. The cylinder 3 in the FIG. 3.3 is shown with conical ends that stretch from an outer diameter of the cylinder 3 to the opening diameter of the openings 3*a* and 3*b* but other shapes are possible. There is a through-running hollow space 3*f* in the cylinder between the opening 3*a* and the opening 3*b*. This hollow space has a larger diameter than the openings 3*a* and 3*b*. Therefore, there are cylinder edges 3*d*, 3*e* on the short side of the hollow space 3*f* on both sides of the openings 3*a* and 3*b*. The cylinder edge 3*e* in the cylinder 3 is set up to meet or strike the hammering edge 10*f* of the hammering part 10 in the hammering position of the tool. A Groove 3*c* is arranged inside the cylinder 3. This is arranged in the same horizontal plane as the slits 10*d* of the hammering part in the initial position of the hammering tool 20 so that the groove 3*c* and the slits 10*d* are align and are corresponding in the initial position of the hammering tool 20.

The locking unit 21 is arranged on the inside of the hammering part 10. The locking unit 21 is shown schematically in FIG. 2, while the individual parts are shown separately in FIGS. 3.4-3.8.

Figure 2:
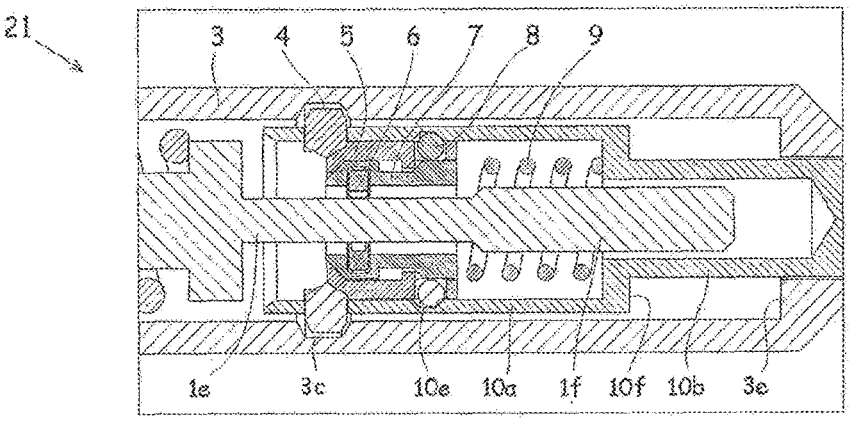
FIG. 2 is a detailed section of the release mechanism in the hammering tool according to the invention.

At least one locking body 4 is arranged in the openings 10*d*. This is shown in detail in FIG. 3.4. The placing of the locking body or bodies in the hammering tool 20 are shown in FIGS. 1 and 2. The locking body or bodies 4 that are shown in the figures comprise a 7-edged block with a groove side 4*a* that lies against the groove 3*c* on the inside of the cylinder 3 in the initial position of the hammering tool 20, two parallel sides 4*c* lie against the surfaces in the slits 10*d* in the hammering part 10. The side 4*a* and the sides 4*c* are connected by tilted sides that run at an angle between the sides. The sides 4*a* and 4*b* lie against the groove 3*c* in the cylinder 3 in the initial position of the hammering tool 20. The locking body 4, have on the inside of the hammering part 10, surfaces 4*d* that run downwards at an angle and form a point 4*e*. In a single-acting hammering tool (FIGS. 1-4.6) the surface 4*d* facing the locking unit 21 lies against a tilted surface 5*a* in the locking unit 21 in the initial position, while in a double-acting hammering tool both the surfaces 4*d* lie against two opposite surfaces 5*a* in the locking unit 21 and 21' on each side of the locking body or bodies 4 (This will be described further in FIGS. 5-8.8). The locking body 4 can also have other shapes that are appropriate for the implementation of the invention. For instance locking body 4 could be an 5-edge block without the sides 4*b* or one tilted surface 4*d* facing the surface 5*a* of the locking unit 21.

There are in the FIG. 2 shown two locking bodies arranged at opposite sides in the cylinder 3. This is e possible embodiment of the invention. There could also be arranged only one locking body 4 or more than two locking bodies 4 in the cylinder, this is possible embodiments of the invention.

FIG. 3.5 shows a cylindrical ball housing 5. This is arranged on the inside of the hammering part 10. The outside of the ball housing 5 lies against the inside of the hammering release end 10*a*. A tilted ball housing end 5*a* lies against the locking body or bodies 4 and is adjusted to the tilt of the side surface 4*d* of the locking body 4. A release spring 9 (shown in FIGS. 2 and 9) is pre-stressed against the ball housing 5 so that the tilted surface 5*a* lies against the tilted surface 4*d* of the respective locking body and forces the locking body radially through the respective slit 10 of the hammering part 10 towards the respective groove 3*c* in the cylinder 3. This prevents axial displacement between the cylinder 3 and the hammering part 10 in the initial position of the hammering tool 20.

Between the ball housing ends 5*a*, an opening 5*d* is arranged that is larger than the second intermediate part 1*e* and the release end 1*f* on the release strut 1. This allow the second intermediate part 1*e* and the release end 1*f* of the release part to move in the longitudinal direction within the ball housing 5.

At least one through-going ball opening 5*c* are also arranged in the ball housing 5. The FIG. 2 shows two openings but just one or more than two openings are also possible. The at least one through going ball opening 5*c* is adjusted to at least one blocking device, for example, at least one spherical or ball shaped blocking member 8. A possible shape of the member is shown in FIG. 3.8. In addition, a stopping edge 5*b* is arranged inside the ball housing 5. The stopping edge 5*b* is arranged perpendicularly to the surface of the ball housing 5, on the inside of the ball housing 5.

The ball housing 5 has a hollow, through-going opening 5*d* in the centre of the ball housing 5 in the longitudinal direction and is set up to surround parts of the release strut 1.

The at least one blocking member 8 from FIG. 3.8 is arranged in the ball openings 5*c* and lie against the groove 10*e* on the inside of the hammering release end 10*a* of the hammering part 10 in the initial position of the hammering tool 20. On the opposite side, the balls 5 lie against a ball wedge 7. There are shown two balls arranged in the ball openings 5*c* in FIG. 2. One ball situated in each of the ball openings 5*c*. Possible embodiments of the invention is only one spherical shaped ball or more than two.

FIG. 3.7 shows the ball wedge 7 in detail. The ball wedge 7 is formed as a cylinder and arranged on the inside of the ball housing 5 and is in contact with the ball housing 5. The ball wedge 7 has a sloping end 7*a* adjusted to the shape of the ball housing 5 and lie against the inside of the ball housing 5. The ball wedge 7 has a longitudinal opening 7*b* axially through the ball wedge 7. The second intermediate part 1*e* and the release end 1*f* of the release strut 1 is adapted to be movable through the opening 7*b* of the ball wedge and is surrounded by this. Furthermore, the ball wedge 7 has a recessed section 7*c* with a diameter that is less than the diameter of the rest of the ball wedge 7. The recessed section 7*c* is arranged near the middle of the ball wedge 7. The transition between the recessed section 7*c* and the ball wedge 7 has a vertical surface 7*g* in the one part 7*d* that faces the release strut 1 and a conical transition 7*c* to the opposite part 7*e*. The ball housing 5 and the ball wedge 7 are set up for axial movement with respect to each other until the stopping edge 5*b* meets the surface 7*d* of the ball wedge 7 or the sloping end 7*d* is in contact with the inside of the ball housing when depending on with the direction the wedge is moved. This is explained in more detail in the FIGS. 4.1-4.6.

Grooves 7*f* are arranged on the inside of the first part 7*d* of the ball wedge. The grooves 7*f* are adapted to receive a fastening mechanism 6, which is, for example, a friction ring. The friction ring 6 is adapted to surround the part 1*e* or 1*f* of the release strut 1, dependent on which position the tool is in.

A possible embodiment of the fastening mechanism 6 is shown in detail in FIG. 3.6. The friction ring 6 has a slit 6*a* across the ring, with ring ends 6*b* and 6*c* on each side of the slit 6*a*. With this, the ring 6 becomes more flexible and can thereby increase the diameter of the ring in that the ring ends 6*a*, 6*b* are forced away from each other so that the release end 1*f* shall be able to be surrounded by the ring 6. Other shapes of the fastening mechanism are also possible.

The release spring 9 shown in FIG. 3.9 is arranged against the hammering release end 10*a*, between the ball wedge 7 and the intermediate piece 10*b* of the hammering part 10. It could formed as a spiral spring and is shown in more detail in FIG. 3.9. The release spring 9 is arranged on the underside of the locking unit 21 to hold the locking bodies 4 in position in the locking groove 3*c*. The release spring also covers other resilient member other than a spiral spring can also be used to obtain the required pre-stressing of the locking unit 21 against the locking bodies 4 and are embodiments of the invention.

FIG. 4.1-FIG. 4.6 show the individual sequences the hammering tool 20 goes through to perform a stroke to for instance to loosen a downhole tool from the hammering tool 20 according to the invention.

FIG. 4.1

The hammering tool 20 is, in its initial position, placed down in a well (not shown). The release strut 1 is connected to a cable or a wire that runs up to the surface (not shown). The hammering part 10 is coupled to the downhole equipment that stretches down into the borehole. These parts are not shown in any of the figures. In this position the force spring 2 is in a initial, free position, i.e. the spring 2 is not compressed. The friction ring 6 surrounds a section of the second intermediate part 1*e* on the release strut 1. The release strut 1 is in this position not coupled to the locking unit and is movable in relation to the locking unit 21 and the hammering part 10.

In this position the at least one locking body 4 engage with the hammering part 10 and the cylinder 3 as previously described so that these cannot be displaced axially with respect to each other.

The locking unit 21 is in a fixed mode where it is pre-stressed against the at least one locking body 4. In this position the locking unit 21 is not displaced with respect to the hammering part 10.

FIG. 4.2

The hammering tool 20 is supplied with an axial force (arrow) in that the cable or wire line is tightened. The force spring 2 inside the cylinder 3 will be gradually compressed in that the release strut 1 is pulled upwards. Kinetic energy will then be stored in the hammering tool 20.

The release strut 1 is pulled upwards until the release end 1*f* meets the friction ring 6. The friction ring 6 forces itself outwards and the release strut 1 moves further upwards through the cylinder 3. The release strut 1 has arrived in this position inside the "release window".

In the FIG. 4.2 the hammering tool 20 is shown in a state where the release strut 1 is in its outermost stretching position and the desired pre-stressing force in the force spring 2 has been reached in that the second stopper or parapet section 1*d* of the release strut 1 and the cylinder edge 3*d* in the cylinder 3 compresses the force spring 2 together. It will also be possible to choose other stretch positions to obtain other pre-stressing forces in the force spring 2.

FIG. 4.3

The pre-stressing force will thereafter diminish somewhat, i.e. the release strut 1 will be pulled downwards towards the well. The friction ring 6 that is arranged in the ball wedge 7 surrounds a section of the releasing end 1*f* of the release strut 1 coupling the friction ring 6 and the release strut 1 together through friction forces. There will be more friction force between the friction ring 6 and the releasing end 1*f* of the release strut 1 than the axial force from the release spring 9 causing both the release strut 1 and the locking unit 21 to move downward. When the release strut 1 is moved towards the well, this leads to a movement of the ball wedge 7 downwards in the same direction and distance as the release strut 1 towards the well until the ball wedge 7 stops in that the surface 7*g* in the ball wedge 7 meets the edge 5*b* in the ball housing 5. In this position the recessed section 7*c* in the ball wedge 7 is in line or contact with the at least one blocking element 8, shown as spherical shaped ball 8 in the figures. In the figures there are shown two spherical shaped balls in opposite ball openings 5 in the ball housing 5. The spherical shaped balls 8 lies in the groove 10*e* in the hammering part 10 and will move out of this groove 10*e* towards the recessed sections 7*c* and the wedge 7 and the ball housing 5 is locked together in the axial direction so that the whole of the locking unit 21 is pushed downwards.

The locking unit 21 is in a released mode in this position in that it can be displaced axially with respect to the hammering part 10.

FIG. 4.4

After the ball housing 5 and the ball wedge 7 have been coupled together the inclining ball housing end 5*a* of the ball housing 5 will be pushed downwards and release the locking bodies 4 because a further movement of the release strut 1 downwards. The locking bodies 4 will be pulled out of the locking grooves 3*c* when the pressure from the locking unit against the locking bodies 4 are released. The locking bodies 4 will be retracted into the cylinder 3 so that the hammering part 10 is released from the cylinder 3 and these parts can be displaced axially with respect to each other. The pre-stressed force spring 2 will accelerate the cylinder 3 upwards until the internal lower edge 3*e* lies or strike against the hammering part 10*f*. The cylinder 3 makes a sudden stop and this leads to a blow in the tool. This position is called the hammering position of the tool.

FIG. 4.5

The stretch force diminishes and the hammering tool is supplied with an axial force (arrow) that will push the release end 1*f* of the release strut 1 back through the friction ring 6 so that the friction ring 6 surrounds a section of the second intermediate part 1*e* of the release strut 1. This force is greater than the friction force between the friction ring 6 and the release end 1*f*.

At the same time the locking bodies 4 are led back into the locking groove 3*c* in the cylinder 3 in that the groove 3*c* and the slits 10*d* of the hammering part 10 are brought back to the initial position where they lie level with each other in the same horizontal plane.

The locking bodies 4 are held in place by the locking unit 21 in that the inclining face 5*a* on the end of the ball housing 5 lies against the opposite inclining face 4*d* of the locking bodies 4. The locking unit 21 is forced against the locking bodies 4 with the help of the release spring 9.

FIG. 4.6 shows the hammering tool back in the initial position and is corresponding to FIG. 4.1

The hammering tool that is described above is preferably single-acting for a wireline. Using the hammering tool as double-acting for a coil tubing, snubbing or well tractor also lies within the invention.

A double-acting hammering tool 30 is shown in FIGS. 5 and 6.

In this embodiment, the shape of the locking unit from FIG. 2 is arranged as upper and lower locking units 21,21'. These form a double-acting locking unit 31 in a hammering part 1000. The locking units 21,21' are arranged the wrong way around ie inverted with respect to each other, one on each side of the locking bodies 4.

Parts of the hammering tool 30 that have a different form than the single-acting hammering tool 20 are shown in more detail in FIGS. 7.1-7.3.

A release strut 100 for a double-acting hammering tool 30 is shown in FIG. 7.1. This has a similar form and parts as the release strut 1 for the single-acting release strut 1, but the release strut 100 has, in addition, a third intermediate part 100*e* and a second release end 100*f*. These are corresponding to the second intermediate part 1*e* and the release end 1*f*. The third intermediate part 100*e* is coupled between the intermediate part 1*d* and the second release end 100*f*. In addition, the release strut 100 has a guiding part 100*h* that is connected between the first parapet section 1*c* and the first intermediate part 1*b*. The guiding part 100*h* has a larger diameter than the intermediate part 1*b* so that there is an edge 100*i* between the parts 100*h* and 1*b*. The other parts are similar as described as the single-acting hammering tool 20.

A cylinder 300 of the double-acting hammering tool 30 is shown in FIG. 7.2. It also has a similar shape as the cylinder 3 of the single-acting hammering tool 20 with parts that are described in more detail in connection to this. The cylinder 300 has a reduced portion 300*g* of the inner diameter in the cylinder 300. This reduced portion 300*g* has a diameter and placing that corresponds to the second parapet section 1*d* of the release strut 100 so that this section is allowed to move through the reduced portion. It has also an outer surface 300*h* that makes up the hammering surface at downwards hammering. The reduced portion 300*g* and the cylinder edge 3*d* defines the boundaries for the force spring 2 in the axial direction.

A hammering part 1000 of the double-acting hammering tool is shown in FIG. 7.3. The new, modified parts on this hammering part 1000 are arranged at the end that faces the release strut 100 and comprises a release end 1000*a* and a groove 1000*e*. These have the same form as the hammering release end 10*a* and the locking groove 10*e*, but are arranged inverted with respect to the slits 10*d*. The hammering part 1000 also has a hammering surface 1000*f* that is formed by the difference in diameter between the intermediate piece 10*b* and the hammering end 10*c*.

In an upward or first directional blow or stroke, the inner edge 3*e* in the cylinder 3 meets the hammering edge 10*f* of the hammering part 10 such as in a single-acting blow, while in a downward or second directional blow or stroke, the outer surface 300*h* of the cylinder 3 meets the hammering surface 1000*f* in the hammering part 1000.

The sequences of the double-acting hammering tool are shown in the FIGS. 8.1-8.8.

Upwards or First Directional Blow/Stroke:

The individual locking units 21 and 21' of the double-acting hammering tool 31 have the same parts and work in the same way as the locking unit 21 of the single-acting hammering tool 20, apart from that the release strut 100 must be pulled up a distance that is sufficient for both the upper and lower locking units 21' and 21 to be released to release the locking bodies 4. The upper locking unit 21' is defined as the locking unit that is nearest the second section of the cylinder 300 or the cable side of the well when the hammering tool 30 is placed in the well. The lower locking unit 21 is defined as the locking unit that is placed nearest the first section of the cylinder 300 or the downhole equipment in the well when the hammering tool 30 is placed in the well.

FIG. 8.1 shows the double-acting hammering tool 30 in its initial position. Then the upper and lower locking units 21 and 21' lie against the locking bodies 4 on both sides of these.

In FIG. 8.2 tension force is supplied and the release strut 100 is pulled upwards/outwards in the cylinder 300 until the release end engage with the friction ring 6 in the lower locking unit 21. The release end 1*f* will surround the friction ring 6 in the lower locking unit 21, but without this mechanism being released as it is locked against any movement in this direction. When the release end 1*f* gradually reaches the upper locking unit 21' and engage with the friction ring 6' in upper locking unit 21' it will be pulled up together with the release strut 100 via the friction ring 6' that surrounds the lowermost release end 1*f*. The upper locking unit 21' will thus be released from the locking bodies 4.

In FIG. 8.3 the supplied tension force by the release strut 100 will diminish somewhat and the compressed force spring 2 will push on the second parapet section 1*d* on the release strut 100 so that it moves somewhat in the opposite direction and the lowest release end 1*f* and the coupling to the friction ring 6 will move the lowest locking unit 21 away from the locking bodies 4. The force that holds the locking bodies in the groove 3*c* in the cylinder is removed.

The upper locking unit 21' will also move downwards towards the locking bodies 4 in this operation, in parallel with the lower locking units 21, but still have so much distance from the locking bodies 4 that it will not come back into engagement with the locking bodies 4 again before the lower locking units 21 are released from the locking bodies 4. The locking bodies 4 are now free and are pulled out of the grooves 3*c*.

In FIG. 8.4 the force spring 2 will accelerate the cylinder 300 until the internal lower edge 3*e* lies against the hammering release end 10*f* resulting in an upwards blow.

Downwards or Second Directional Blow/Stroke:

FIG. 8.5 shows the double-acting hammering tool 30 in its initial position. Then the upper and lower locking units 21, 21' lie against the locking bodies 4 on both sides of the locking bodies and forcing the locking bodies in the groove 3*c* of the cylinder.

In FIG. 8.6 a pressure force is supplied and the release strut 100 is pushed down/inwards through the cylinder 300. The release end 100*f* will, at first, surround the friction ring 6' in the upper locking unit 21', but without this locking unit 21' being released as it is locked against movement in this direction. When the release strut 100 gradually reaches the lower locking unit 21, it will be released and be pulled down together with the release strut 100 via the friction ring 6 that surrounds the uppermost release end 100*f*. The lower locking unit 21 is thereafter released from the locking bodies 4.

In FIG. 8.7 supplied pressure force from the release strut 100 will diminish somewhat and the compressed force spring 2 will push on the surface 100*i* on the release strut 100 so that this goes back somewhat, and the uppermost release end 100*f* will drag along the friction ring 6' that releases the upper locking unit 21' from the locking bodies 4. The lower locking unit 21 will also move up/outwards towards the locking bodies 4 in this operation, in parallel with the upper locking units 21', but still have so much distance from the locking bodies 4 that they will not come back into engagement with the locking bodies 4 again before the upper locking units 21' are released from the locking bodies 4. The locking bodies 4 are now free and are led out of the locking groove 3*c*.

In FIG. 8.8 the force spring 2 will accelerate the cylinder 300 until the external lower surface 300*h* lies against the edge 1000*f* resulting in a downwards blow. The double acting release spring having a release spring arranged within the hammering release part below the locking unit 21 and above the locking unit 21'.

By release of the locking unit 21 and 21' it is referred to the sequences described in relation to the single-acting hammer tool with the ball housing, ball wedge, ball, friction ring etc.

It is to be understand that the mode of operation of the hammering tool depends on the relation between the force spring 2, the release spring 9 and the friction force between the release end 1*f* of the release strut 1 and the friction ring 6.

The mechanism within the locking unit 21 and 21' is in this embodiment

All position references such as upwards, downwards, upper and lower are defined according to a normal placing of the hammering tool in the well.

The arrangement of a hammering tool according to the invention will be able to include any features that are described or illustrated herein, in any operative combination; any such operative combination will be an embodiment of the arrangement for the hammering tool that is according to the invention. The method of the invention will be able to encompass any feature or step that has been described herein or that has been illustrated, in any combination, where any such combination will be an embodiment of the method according to the invention.

Meant by functionally coupled is that the parts do not need to be coupled directly, but can be coupled via other parts the coupling could also be a friction coupling.

The invention claimed is:

1. A cable-operated hammering tool for downhole operations, the cable-operated hammering tool comprising:

a cylinder comprising an axially through-going internal opening;

a hammering part arranged in a first section of the cylinder;

wherein the hammering part is fitted with a detachable coupling for connection with a downhole equipment;

a release strut arranged in a second section of the cylinder, the release strut is adapted to be connected to a surface installation via a cable;

wherein the hammering part is detachably coupled to the cylinder by at least one locking unit in a locked position of the at least one locking unit; and wherein the cable operated hammering tool comprises a force spring that is in contact with the release strut for the pre-biasing of the release strut by movement of the release strut in a first direction;

wherein the release strut is displaceable in a second opposite direction; and wherein the release strut is coupled to the at least one locking unit so that when the release strut is moving in the second opposite direction, the release strut displaces the at least one locking unit from the locked position thereby releasing the hammering part from the cylinder.

2. The cable-operated hammering tool according to claim 1, wherein:

the cylinder comprises a cylinder edge;

the hammering part comprises a hammering edge; and the cylinder edge and the hammering edge are adapted to hit against each other after displacing the locking unit from the locked position.

3. The cable-operated hammering tool according to claim 2, wherein pre-stressing of the cable operated hammering tool by the release strut is infinitely variable and set up to impart variable blows between the cylinder edge and the hammering edge.

4. The cable-operated hammering tool according to claim 1, wherein at least one locking body is adapted to hold the cylinder and the hammering part in detachable engagement by the at least one locking unit and a release spring.

5. The cable-operated hammering tool according to claim 4, wherein the at least one locking unit and the release spring are arranged between the release strut and the hammering part.

6. The cable-operated hammering tool according to claim 4, wherein:

the at least one locking unit comprises a released mode where the at least one locking unit is displaced axially in relation to the hammering part and a fixed mode where the at least one locking unit is in a fixed position in relation to the hammering part;

the at least one locking unit comprises a ball housing arranged adjoining an inside of the hammering part and a ball wedge arranged on an inside of the ball housing; and at least one blocking element is arranged between the ball housing and the ball wedge, the at least one blocking element is adapted to fasten the ball housing and the ball wedge together in the released mode of the locking unit.

7. The cable-operated hammering tool according to claim 4, wherein a fastening mechanism is arranged between the ball wedge and the release strut and is adapted to couple a release end of the release strut and the locking unit together.

8. The cable-operated hammering tool according to claim 7, wherein the fastening mechanism comprises a friction ring.

9. The cable-operated hammering tool according to claim 1, wherein a hammering force of the cable operated hammering tool is defined by supplying pulling power in the cable.

10. The cable-operated hammering tool according to claim 1, wherein the force spring is arranged around the release strut.

11. A method for operation of a hammering tool for downhole operations, the hammering tool comprising:

a cylinder comprising an axially through-going internal opening, wherein the cylinder is fitted with an internal cylinder edge;

a hammering part arranged in a first section of the cylinder and fitted with a detachable coupling for a connection with a downhole equipment, wherein the hammering part is fitted with a hammering edge;

a release strut arranged in a second section of the cylinder is adapted to be connected to a surface installation via a cable;

the hammering part is detachably coupled to the cylinder by at least one locking unit in a locked position of the at least one locking unit;

at least one locking body is arranged between the cylinder and the hammering part, wherein the at least one locking body is adapted to couple the cylinder and hammering part together;

wherein:

a) the release strut is moved a distance in a first axial direction to compress a force spring to a pre-stressing force, the force spring is arranged between the cylinder and the release strut;

b) the release strut is moved a distance in a direction opposite to the first axial direction and the at least one locking unit is moved a distance from the at least one locking body so that the pre-stressing force diminishes;

c) the at least one locking body is pulled out from the cylinder housing;

d) the pre-stressing force in the force spring causing the cylinder to move a distance in the first axial direction;

e) the cylinder edge meets the hammering edge resulting in a blow by the tool; and f) the release strut is pulled back by the force spring and the at least one locking unit is pulled towards the at least one locking body, the at least one locking body is adapted to be moved in engagement with the cylinder back to the locked position.

12. The method according to claim 11, wherein when the release strut in step a) is pulled upwards, an internal lower edge of the cylinder meets the hammering edge of the hammer part in an upward blow.

13. The method according to claim 11, wherein the steps a-f are repeated in that the release strut in a) is led alternately in the opposite direction in a double-acting hammering operation.

* * * * *